US007442122B2

(12) United States Patent
Yaldoo et al.

(10) Patent No.: US 7,442,122 B2
(45) Date of Patent: Oct. 28, 2008

(54) VARIABLE LOTTERY GAME ALLOWING PARTICIPATION IN SEVERAL DIFFERENT LOTTERY GAMES WITHIN A SINGLE DRAWING

(75) Inventors: Steve Peter Yaldoo, Farmington Hills, MI (US); Kevin David Yaldoo, Dearborn, MI (US)

(73) Assignee: Advanced Gaming Concepts, LLC, Dearborn, MI (US)

( * ) Notice: Subject to any disclaimer, the term of this patent is extended or adjusted under 35 U.S.C. 154(b) by 528 days.

(21) Appl. No.: 11/189,405

(22) Filed: Jul. 26, 2005

(65) Prior Publication Data

US 2007/0026927 A1 Feb. 1, 2007

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/17; 463/16; 463/25

(58) Field of Classification Search ..... 463/16, 463/17, 25

See application file for complete search history.

(56) References Cited

U.S. PATENT DOCUMENTS

| | | | | | |
|---|---|---|---|---|---|
| 4,842,278 | A * | 6/1989 | Markowicz | 463/18 |
| 5,116,049 | A * | 5/1992 | Sludikoff et al. | 273/139 |
| 5,232,221 | A * | 8/1993 | Sludikoff et al. | 273/139 |
| 5,269,523 | A * | 12/1993 | Boylan et al. | 273/138.1 |
| 5,273,281 | A * | 12/1993 | Lovell | 273/138.1 |
| 5,451,052 | A * | 9/1995 | Behm et al. | 273/139 |
| 5,979,894 | A * | 11/1999 | Alexoff | 273/139 |
| 6,086,477 | A * | 7/2000 | Walker et al. | 463/17 |
| 6,572,106 | B2 * | 6/2003 | Alexoff | 273/138.1 |
| 6,616,531 | B1 * | 9/2003 | Mullins | 463/19 |
| 6,874,783 | B2 | 4/2005 | Higginson | |
| 6,887,152 | B2 | 5/2005 | Stanek | |
| 2003/0003981 | A1 * | 1/2003 | Valenti | 463/16 |
| 2003/0047869 | A1 * | 3/2003 | Walker et al. | 273/139 |
| 2003/0122303 | A1 * | 7/2003 | Moore | 273/269 |
| 2004/0032084 | A1 * | 2/2004 | Higginson | 273/269 |
| 2005/0003884 | A1 * | 1/2005 | Meyer et al. | 463/17 |
| 2005/0104286 | A1 * | 5/2005 | Krietemeyer | 273/138.1 |
| 2006/0014578 | A1 * | 1/2006 | Lovell | 463/17 |

* cited by examiner

*Primary Examiner*—Robert Pezzuto
*Assistant Examiner*—Milap Shah
(74) *Attorney, Agent, or Firm*—Mastrogiacomo PLLC; Patrick Mastrogiacomo, Jr.

(57) ABSTRACT

A method for simultaneously conducting multiple lottery style games of chance allowing for multiple wagers and payouts within a single drawing is provided. The method is comprised of selecting a number from a first group of numbers for Game 1. Selecting a number from the first group of numbers and a number from a second group of numbers for Game 2. Selecting a number from each of the first group of numbers and the second group of numbers, and multiple numbers from a third group of numbers for Game 3. Winning numbers are randomly generated from the first group of numbers, the second group of numbers, and multiple winning numbers are generated from the third group of numbers. Prizes are awarded based on the selection of Game 1, Game 2, and/or Game 3, and whether selected number or numbers match the randomly generated number or numbers.

20 Claims, 7 Drawing Sheets

VARIABLE LOTTERY GAME ALLOWING PARTICIPATION IN SEVERAL DIFFERENT LOTTERY GAMES WITHIN A SINGLE DRAWING

STATEMENT REGARDING FEDERALLY SPONSORED RESEARCH OR DEVELOPMENT

Not Applicable.

CROSS REFERENCE TO RELATED APPLICATIONS

Not Applicable.

INCORPORATION-BY-REFERENCE OF MATERIAL SUBMITTED ON COMPACT DISC

Not Applicable.

BACKGROUND OF THE INVENTION

1. Field of the Invention

The present invention relates generally to games of chance and, more particularly, to lottery based games of chances allowing for the opportunity to participate in several different games within a single drawing, the changes of winning a cash prize dependent on exactly matching randomly generated numbers.

2. Background Art

Games of chance and, especially lottery style games of chance, have been in existence for many years. Generally, these lottery games are under the control of a state or a number of states. The revenues generated from lottery style games of chance are typically shared with the public school systems within the states as a means of subsidizing the cost of programs for children attending public schools. Schools often depend heavily on the revenues from state run lotteries to give children every possibly learning advantage. States are continually seeking the next new great lottery game to keep interest high among the players, which, in turn, helps to ensure a steady stream of revenues for the state and the public school system.

One lottery style game in use today involves a player selecting a number, generally consisting of three or four digits, and attempting to match that number with a number generated in some manner by a state's lottery commission. Typically, there are a number of different games a player may participate in by choosing digits. One such way to play a game is to match the number selected by the player with the generated number digit for digit, in the exact order as generated. If the player is successful in matching his or her selected number with the state generated number, he or she wins some portion of a jackpot.

Rather than attempt to match the randomly generated number digit for digit, the player may decide to "box" his or her selected number. This means that the number selected by the player may be matched with the number randomly generated by the lottery commission in any order. The numbers do not have to match digit for digit. Generally, a person winning this type of game receives some lower jackpot then a person matching a number digit for digit. While these are very popular games among the players, so popular in fact that some states have instituted a mid-day as well as evening drawing, interest often lags in these types of games because the jackpots are not substantial or the novelty of this type of lottery has given way to other lottery games of chance, such as scratch off tickets.

Scratch off lottery style games of chance are very popular among consumers because they offer a person many different ways to participate in the games. One important feature of the scratch off style of games is that the player knows instantly whether or not he or she has won a prize as opposed to waiting a period of time until the mid-day or evening drawing. Another aspect of scratch off tickets is that the design of the ticket may be readily changed. Along with having the ability to readily change the ticket design, a new marketing scheme may be easily developed and employed to increase the interest in a particular game. The change in the style of ticket and the marketing scheme is an attempt to capture and hold the interest of the players. While the designs of tickets and new marketing schemes may be developed, the underlying game of chance is largely the same, which may lead to disinterest among the "regular" players. Also, larger wagers may be charged for playing the scratch off games, than the games described above, in exchange for larger jackpots. While the prizes offered may be larger than the games described above, these prizes still do not approach the jackpots that have been won by players in the other types of games described below.

Another type of lottery game that offers the change of larger jacketpots, typically in the millions of dollars, involves the selection of numbers from a first group of numbers and a selection of numbers from a second group of numbers. In a typical game, a player may select five numbers from a first group of numbers ranging from one through seventy and one number from a second group of numbers ranging from one through thirty. The numbers are generated by the lottery commission as described above. The jackpot winners are determined by the person that matches are five numbers from the first group and the single number from the second group. A person may also win a share of the jackpot by matching only the five numbers from the first group and not matching the number from the second group or matching four of the five numbers from the first group and the single number form the second group.

This type of game also has the added feature of allowing players from multiple states to participate in the game at one time. With a larger number of participants, larger jackpots in the hundreds of millions of dollars may be realized by the eventual winners, in turn leading to greater interest.

The odds of winning the jackpot weigh greatly against the person, however, the chance to win millions of dollars and the fact that a portion of the jackpot may be paid out for a partial match are enticing to players. However, as with many forms of entertainment, boredom often sets in and new lottery style games of chance are developed to keep interests high and revenues increasing. Also, because the jackpots are so large and with the difficult logistics of running the game across many different states, the winning numbers are generally drawn only twice a week, leaving a lag time in between action and resulting in a loss of interest by everyday players.

Therefore, a need exists for a lottery style game of chance that increases the interest of consumers by offering a variety of ways to play the game with a single or multiple wagers on a more frequent basis while providing a relatively large jackpot to potential winners.

BRIEF SUMMARY OF THE INVENTION

In accordance with the present invention a method for simultaneously conducting multiple lottery style games of chance allowing for multiple wagers and multiple payouts is provided. The method is comprised of selecting a number from a first group of numbers for entry into a Game 1. Selecting a number from the first group of numbers and a number from a second group of numbers for entry into a Game 2. Selecting a number from the first group of numbers, a number from the second group of numbers, and multiple numbers from a third group of numbers for entry into a Game 3. A single drawing of winning numbers is conducted for each of Game 1, Game 2 and Game 3. A winning number is randomly generating from the first group of numbers, from the second group of numbers, and multiple winning numbers are generated from the third group of numbers. Prizes are awarded based on the selection of Game 1, Game 2, and/or Game 3, and whether the selected number or numbers match the randomly generated number of numbers for the selected games.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
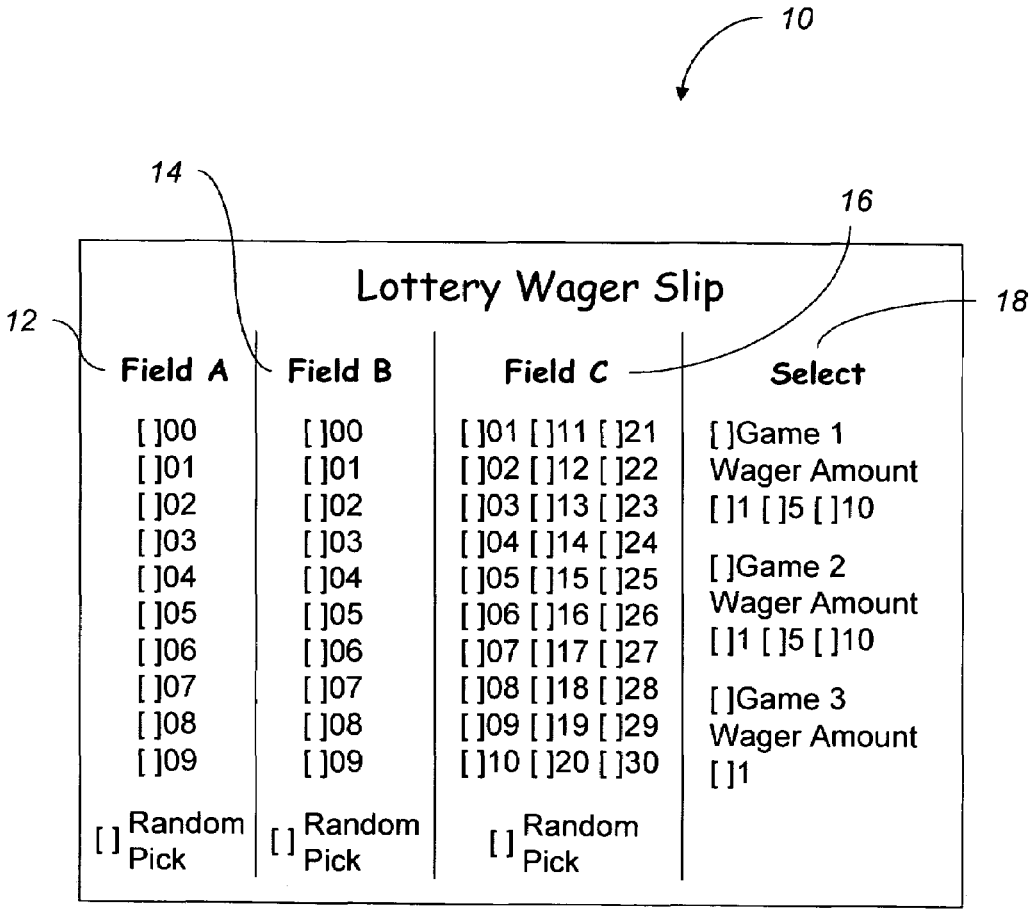
FIG. 1 is a plan view of a lottery wager slip according to an embodiment of the present invention.
Figure 2:
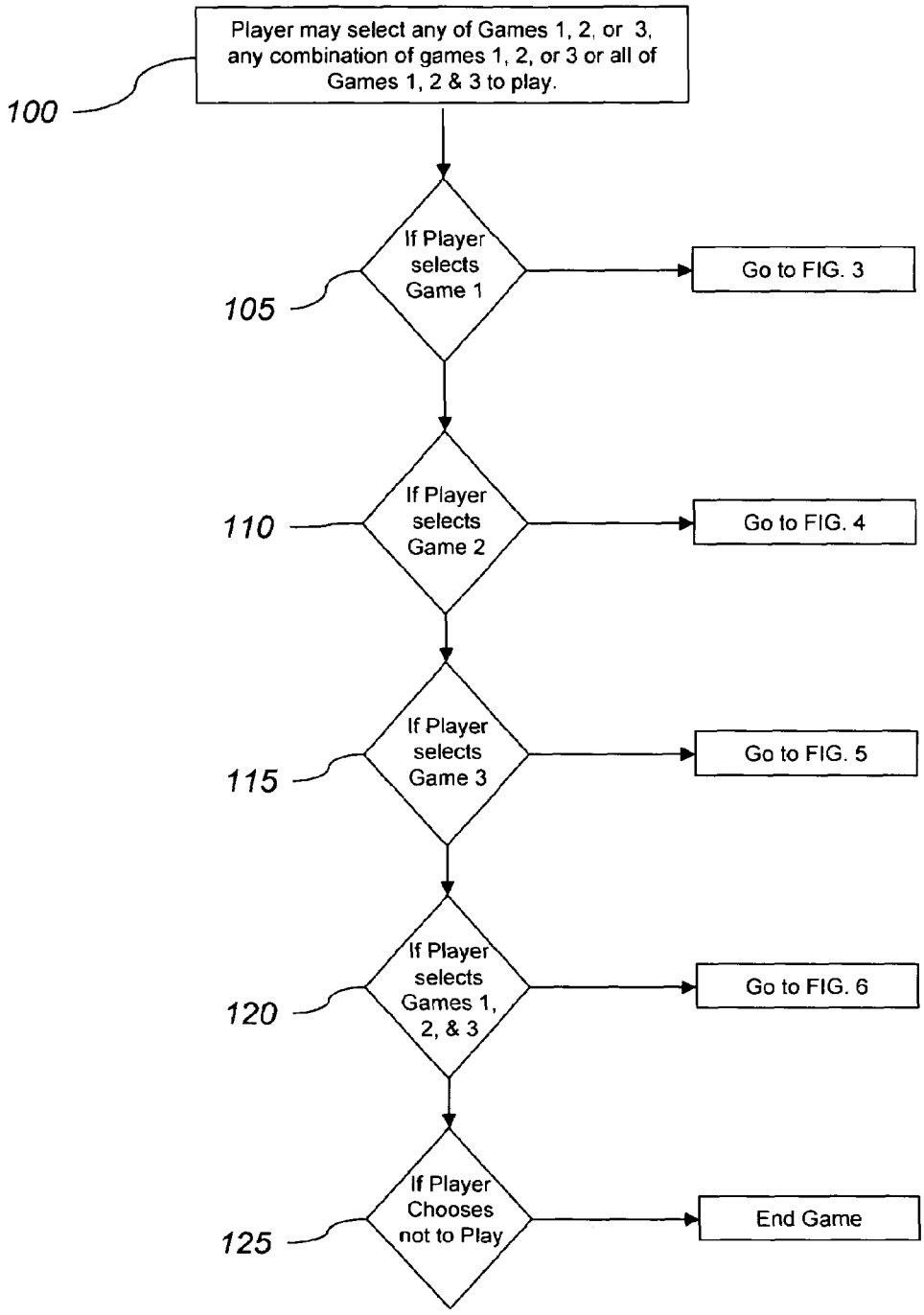
FIG. 2 is a flow diagram offering players the change to play one of three lottery games of chance, some combination of the three of the lottery games of chance, or all three lottery games of chance according to an embodiment of the present invention.

Referring now to the drawings, a preferred illustrative embodiment of the present invention is shown in detail. Although the drawings represent an embodiment of the present invention, the drawings are not necessarily to scale and certain features may be exaggerated to better illustrate and explain the present invention. Further, the embodiment set forth herein is not intended to be exhaustive or otherwise to limit or restrict the invention to the precise forms and configurations shown in the drawings and disclosed in the following detailed description.

Illustrated in FIG. 1 is an example of what a typical lottery wager slip 10 may resemble according to an embodiment of the present invention. Included within wager slip 10 are a number of betting fields, Field A 12, Field B 14, and Field C 16. Each of the fields contains a range of numbers that a lottery player may select from when making a wager. Also shown on wager slip 10 is a game selection area 18, used by the player to identify to a state's lottery commission which game or games the player will be participating in and the amount of the wager the player is choosing to make.

FIGS. 2-7 are flow diagrams that depict the operation of a lottery style game of chance according to an embodiment of the present invention. In this particular embodiment, a player is offered the opportunity to wager on three separate lottery style games of chance, any combination of the three games, or the player may elect to play all three games at the same time. Shown in FIG. 2, as depicted in a flow diagram, is the possible thought process the player may traverse in deciding what game or games to engage. At step 100, the player would determine what game or games to play. Generally, the player will fill out wager slip 10 (see FIG. 1) that may be found at any licensed retailer and hand the slip to the retailer to be entered into a lottery computer that verifies the wager and provides the player a receipt indicating the game or games played and the wager made. The player indicates on wager slip 10 what game or games he or she is interested in playing by marking in the specified game selection area 18 of the wager slip. The player may select to engage in Game 1 at step 105, Game 2 at step 110, Game 3 at step 115 or the player may elect to play all Games 1, 2, and 3 at step 120. The player may elect to engage in any combination of Games 1, 2, or 3 as well. If, for example, the player chooses to participate in Games 1 and 2 and not Game 3, the player places separate wagers for and elects to engage Game 1 at step 105 and Game 2 at step 110. The player may also decide not to play any of the games offered and end the game at step 125.

Figure 3:
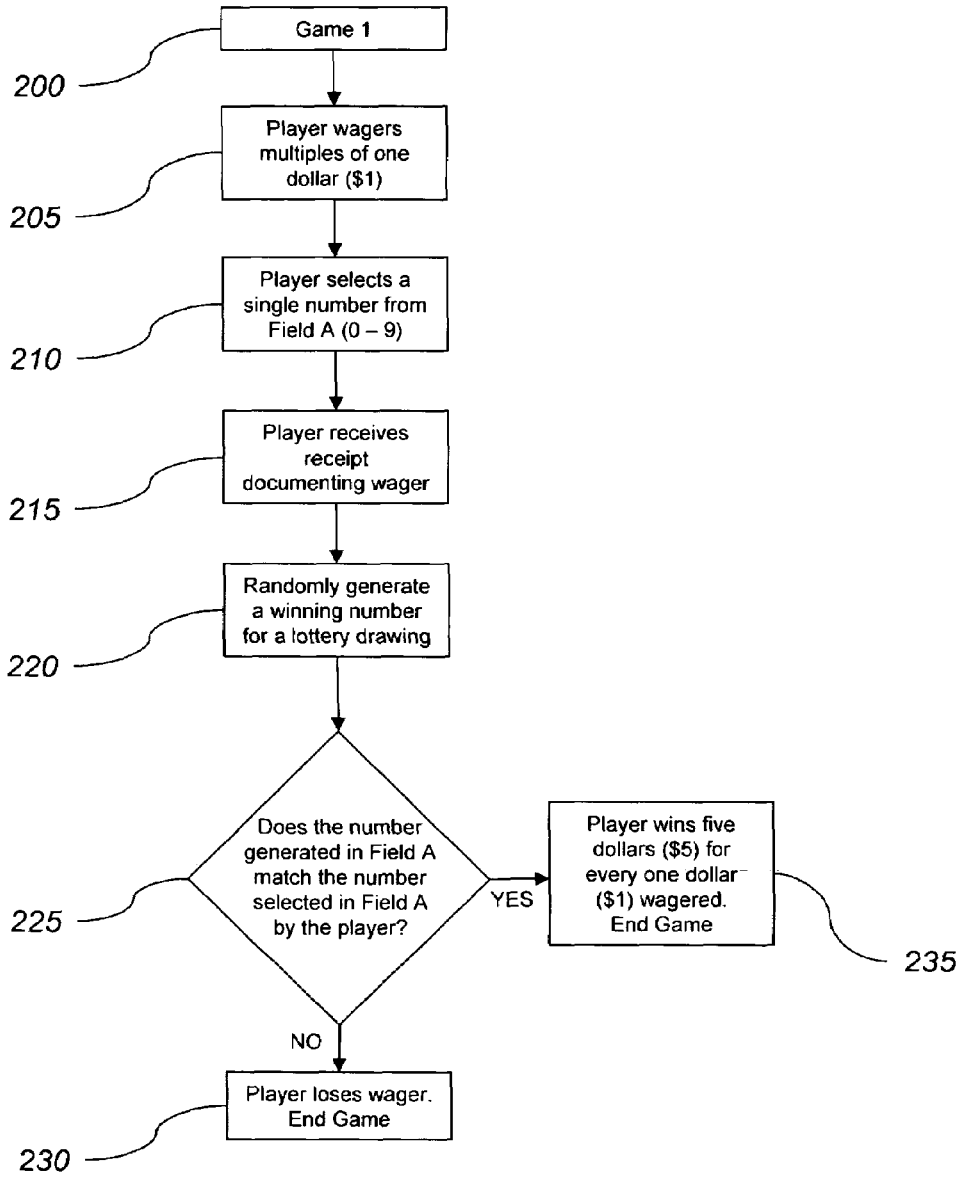
FIG. 3 is a flow diagram depicting the operation of Game 1 according to an embodiment of the present invention.

FIG. 3 depicts a flow diagram for the operation of Game 1 if the player chooses to engage Game 1 at step 200. The player will decide how much he or she wishes to wager on the game, in multiples of one dollar ($1) at step 205, keeping in mind that the larger the wager, the higher the payout if the player does indeed win the game. Next, at step 210, the player selects a single digit number from the field of numbers ranging from zero (0) through nine (9). The player marks his or her choice in Field A 12 on wager slip 10 and hands the wager slip along with his or her wager to the licensed lottery retailer. Alternatively, the player may elect to have the single number chosen randomly by a computer, rather than selecting a number from Field A. The retailer supplies the player with a wager receipt documenting the wager made by the player at step 215.

Generally, the state lottery commission holds a drawing, the frequency of which to be determined by that entity, to generate a set of winning numbers that players compare to the numbers they have selected and are contained on their wager receipt. If the numbers on their wager receipts match the numbers generated by the state lottery commission, the player wins a prize, typically some denomination of a cash prize. The generation of numbers for use with this particular embodiment would be no different. The state lottery commission generates a single winning number in any manner it chooses, as depicted at step 220. After the winning number has been generated, the player compares the winning number that has been generated with the number he or she selected and is contained on the wager receipt at step 225. If the generated winning number does not match the number on the wager receipt, the player loses the game along with his or her wager and the game ends at step 230. If, however, the generated winning number matches the number on the wager receipt, the player wins the game and a cash prize equal to five dollars ($5) for every one dollar ($1) wagered at step 235.

The examples of wager and cash prize amounts described above have been employed merely to illustrate an embodiment of the present invention. It must be understood that Game 1 may be played with any cash denominations for wagers and cash prizes for jackpots and secondary cash payouts, as determined by the entity controlling the operation of the game.

Figure 4:
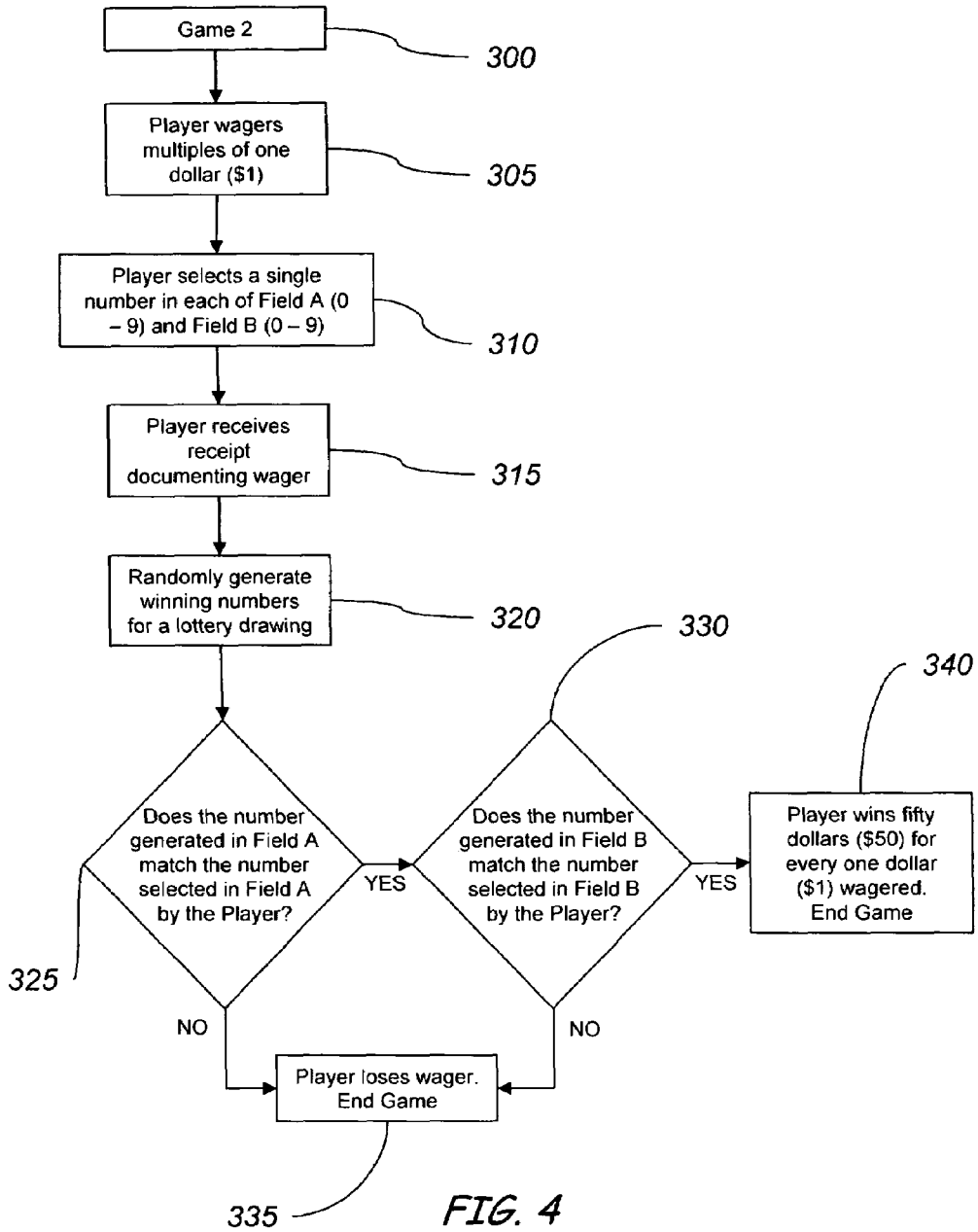
FIG. 4 is a flow diagram depicting the operation of Game 2 according to an embodiment of the present invention.

FIG. 4 depicts a flow diagram for the operation of Game 2 if the player chooses to engage Game 2 at step 300. The player will decide how much he or she wishes to wager on the game, in multiples of one dollar ($1) at step 305, keeping in mind that the larger the wager, the higher the payout if the player does indeed win the game. Next, at step 310, the player selects a single digit number from Field A 12, with numbers ranging from zero (0) through nine (9) and a second single digit number from Field B 14 also with numbers ranging from zero (0) through nine (9). The player marks his or her choice of number in Field A 12 and his or her choice of number in Field B 14 on wager slip 10 and hands the wager slip along with his or her wager to the licensed lottery retailer. Alternatively, the player may elect to have the single numbers for Field A and Field B chosen randomly by a computer, rather than selecting a number from Field A and Field B. The retailer supplies the player with a wager receipt documenting the wager made by the player at step 315.

As described above, the state lottery commission generates a single winning number for Field A and a single winning number for Field B in any manner it chooses, as depicted at step 320. After the winning number for Field A and the winning number for Field B have been generated, the player compares the winning numbers that have been generated with the number he or she selected in Field A and the number he or she selected in Field B and contained on the wager receipt at steps 325 and 330. The player must be careful to note that the numbers generated for Field A pertain only to Field A on the wager receipt and the number generated for Field B pertains only to Field B on the wager receipt.

If the generated wining number for Field A does not match the number on the wager receipt, the player loses the game along with his or her wager and the game ends at step 335. If, however, the generated winning number for Field A matches the number on the wager receipt for Field A, the player compares the generated winning number for Field B with the number on the wager receipt for Field B. If the generated winning number for Field B does not match the number for Field B on the wager receipt, the player loses the game along with his or her wager and the game ends at step 335. If, however, the generated winning number for Field B matches the number on the wager receipt for Field B, the player wins the game and a cash prize equal to fifty dollars ($50) for every one dollar ($1) wagered at step 340.

The examples of wager and cash prize amounts described above have been employed merely to illustrate an embodiment of the present invention. It must be understood that Game 2 may be played with any cash denominations for wagers and cash prizes for jackpots and secondary cash payouts, as determined by the entity controlling the operation of the game.

Figure 5:
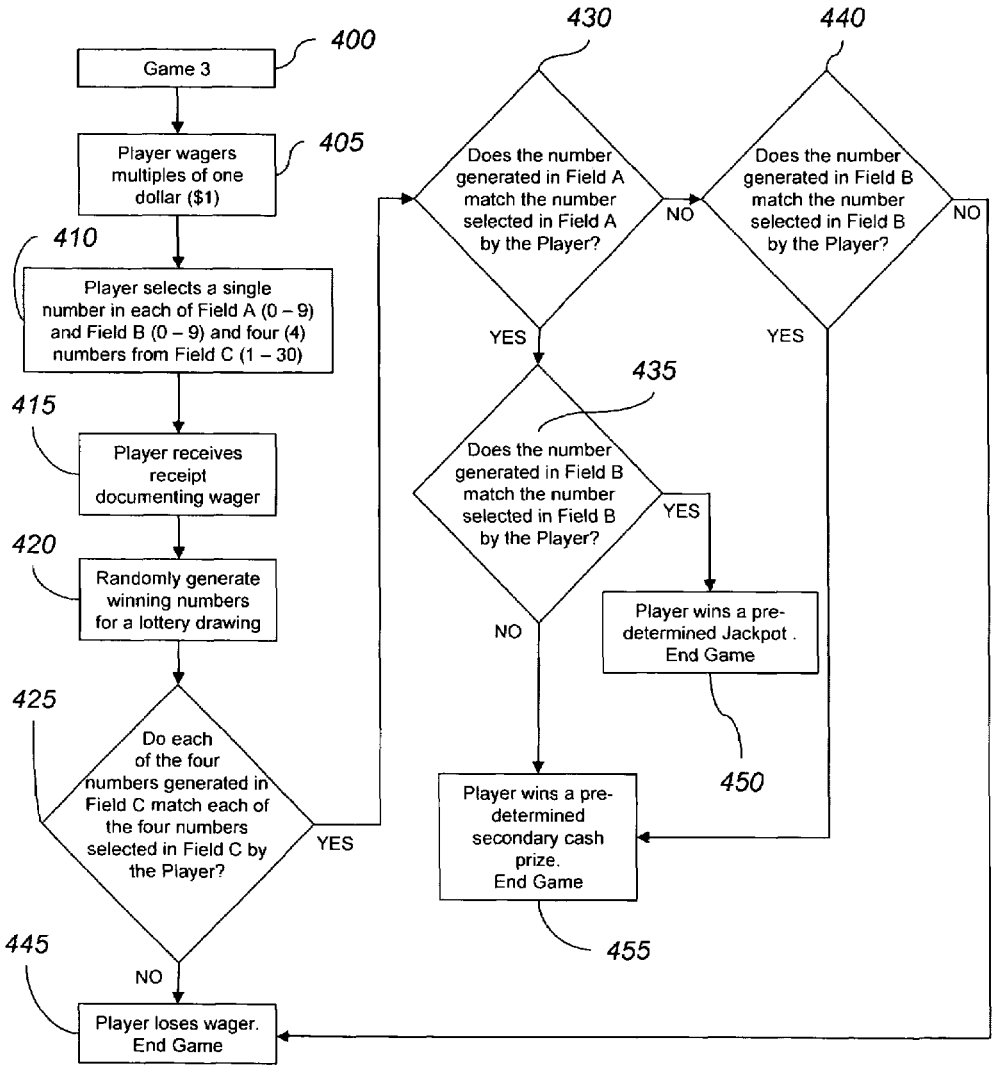
FIG. 5 is a flow diagram depicting the operation of Game 3 according to an embodiment of the present invention.
Figure 6:
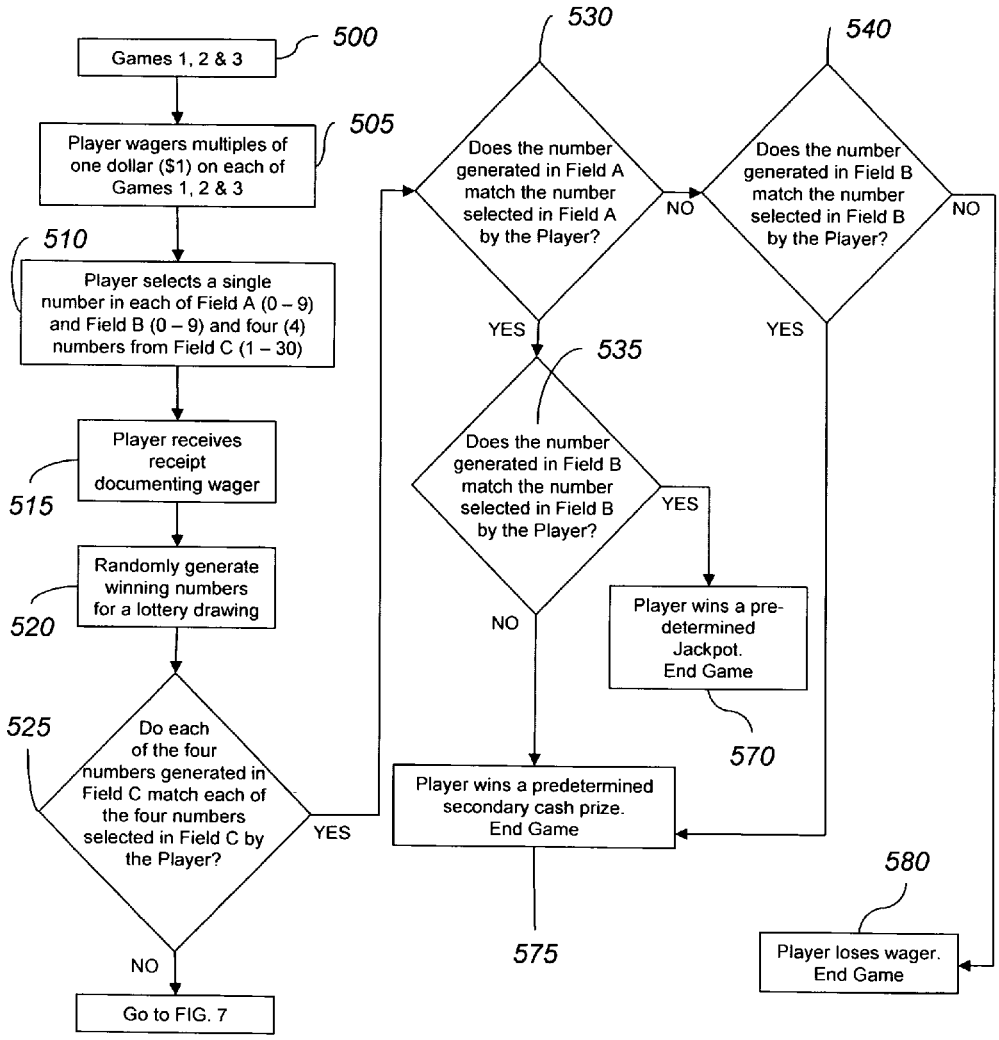
FIGS. 6 and 7 are flow diagrams depicting the operation of all three games according to an embodiment of the present invention.
Figure 7:
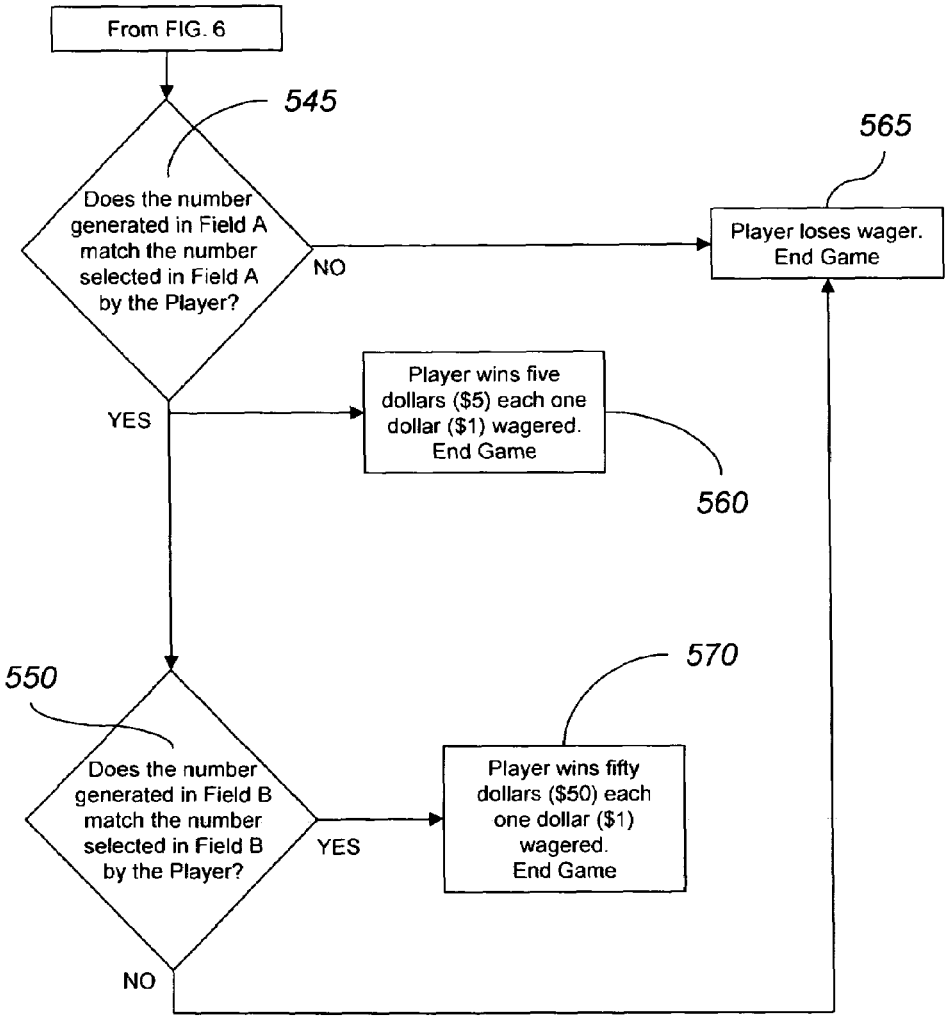

FIG. 5 depicts a flow diagram for the operation of Game 3 if the player chooses to engage Game 3 at step 400. The player will decide how much he or she wishes to wager on the game, in multiple of one dollar ($1) at step 405. Next, at step 410, the player selects a single digit number from Field A 12, with numbers ranging from zero (0) through nine (9), a second single digit number from Field B 14 also with numbers ranging from zero (0) through nine (9), and finally, a selection of four (4) numbers from Field C 16 with numbers ranging from one (1) through thirty (30). The player marks his or her choice of number in the Field A 12, his or her choice of number in Field B 14, and his or her choice of four (4) numbers in Field C 16 on wager slip 10 and hands the wager slip along with his or her wager to the licensed lottery retailer. Alternatively, the player may elect to have the single numbers for Field A and Field B as well as the multiple numbers for Field C chosen randomly by a computer, rather than selecting a number from Field A and Field B and multiple numbers from Field C. The retainer supplies the player with a wager receipt documenting the wager made by the player at step 415.

While Field C of this particular embodiment is a field of numbers from one through thirty, it must be understood that the size of Field C is present for illustration purposes only and may be any size of numbers as determined by the entity controlling the operation of the game. Furthermore, the choice of four numbers from Field C is also provided for illustration as well in this particular embodiment. The selection of winning numbers may be of any size as determined by the state lottery commission or any entity controlling the operation of the game.

As described above, the state lottery commission generates a single winning number for Field A, a second single winning number for Field B, and four winning numbers for Field C in any manner it chooses, as depicted at step 420. After the winning number for Field A, the winning number for Field B, and the four (4) winning numbers for Field C have been generated, the player will then compare the winning numbers that have been generated with the number he or she selected in Field A, the number he or she selected in Field B, and the four (4) numbers selected in Field C and contained on the wager receipts at steps 425, 430, 435, and 440. The player must be careful to note that the numbers generated for Field A pertain only to Field A on the wager receipt and the number generated for Field B pertains only to Field B on the wager receipt and the numbers generated for Field C pertain only to Field C on the wager receipt.

At step 425, the player inspects the numbers he selected for Field C with those that have been randomly generated. If the four (4) generated winning numbers for Field C do not match all four (4) of the numbers on the wager receipt, the player loses the game along with his or her wager and the game ends at step 445. If, however, the four (4) generated winning numbers for Field C match all four (4) of the numbers on the wager receipt for Field C, the player compares the generated winning number for Field A with the number on the wager receipt for Field A. If the generated winning number for Field A matches the number for Field A on the wager receipt, the player then compares the generated winning number for Field B with the number on the wager receipt for Field B. If the generated winning number for Field B matches the number on the wager receipt for Field B, the player wins the game and a cash prize jackpot equal to a pre-determined amount set by the state lottery commission at step 450.

If the generated winning number for Field A matches the number for Field A on the wager receipt at step 430, but the generated winning number for Field B does not match the number for Field B on the wager receipt at step 435, the player wins a secondary cash prize to be determined by the state's lottery commission at step 455. If, however, the generated winning number for Field B matches the number for Field B on the wager receipt, but the generated winning number for Field A does not match number for Field A on the wager receipt, the player still wins a secondary cash prize to be determined by the state's lottery commission at step 455.

If the generated winning number for Field A does not match the number for Field A on the wager receipt and the generated winning number for Field B does not match the number for Field B on the wager receipt, the player loses the game and his or her wager and the game ends at step 445.

The examples of wager and cash prize amounts described above have been employed merely to illustrate an embodiment of the present invention. It must be understood that Game 3 may be played with any cash denominations for wagers and cash prizes for jackpots and secondary cash payouts, as determined by the entity controlling the operation of the game.

The player may also elect to participate in all three games simultaneously in a single drawing. This scenario is depicted in the flow diagrams illustrated in FIGS. 6 and 7 and beginning with step 500. Next, the player decides how much he or she wishes to wager on each individual game, Game 1, Game 2, and Game 3, in multiples of one dollar ($1), at step 505, keeping in mind that multiple one dollar ($1) wagers may lead to higher payouts if the player wins some part of the game. At step 510, just as described in the game 3 scenario, the player selects a single digit number from Field A 12, with numbers ranging from zero (0) through nine (9), a second single digit number from Field B 14 also with numbers ranging from zero (0) through nine (9), and finally, a selection of four (4) numbers from Field C 16 with numbers ranging from one (1) through thirty (30). The player marks his or her choice of number in the Field A 12, his or her choice of number in Field B 14, and his or her choice of four (4) numbers in Field C 16 on wager slip 10 and hands the wager slip along with his or her wager to the licensed lottery retailer. The retailer supplies the layer with a wager receipt documenting the wager made by the player at step 515.

While Field C of this particular embodiment is a field of numbers from one through thirty, it must be understood that the size of Field C is presented for illustration purposes only and may be any size of numbers as determined by the entity controlling the operation of the game. Furthermore, the choice of four numbers from Field C is also provided for illustration as well in this particular embodiment. The selection of winning numbers may be of any size as determined by the state lottery commission or any entity controlling the operation of the game.

As described above, the state lottery commission generates a single winning number for Field A, a second single winning number for Field B, and four winning numbers for Field C in any manner it chooses, as depicted at step 520. After the winning number for Field A, the winning number for Field B, and the four (4) winning numbers for Field C have been generated, the player compares the winning numbers that have been generated with the number he or she selected if Field A, the number he or she selected in Field B, and the four (4) numbers selected in Field C as documented on the wager receipt at steps 525, 530, 535, 540, 545, 550, and 555. The player must be careful to note that the numbers generated for Field A pertain only to Field A on the wager receipt and the number generated for Field B pertains only to Field B on the wager receipt and the numbers generated for Field C pertain only to Field C on the wager receipt.

At step 525, the player inspects the numbers he selected for Field C with those that have been randomly generated. If the four (4) generated winning numbers for Field C do not match all four (4) of the numbers of the wager receipt as determined at step 525, the player will then determine whether he or she has won a cash prize by reviewing the selected numbers depicted on the wager receipt to identify a match in either Field A or Field B at steps 545 and 550 (see FIG. 6). If the number contained in the wager receipt for either Field A or both Fields A and B, match the generated winning numbers, the player wins the game and a cash prize. If the number contained in the wager receipt for Field A matches the generated winning number for Field A at step 454, the player wins a cash prize equal to five dollars ($5) for every one dollar ($1) wagered at step 560, just as described in Game 1 above. If the generated winning number for Field A does not match the number on the wager receipt, the player loses the game along with his or her wager and the game ends at step 565.

If the generated number for Field A does match the number contained in the wager receipt, along with winning the Game 1 cash prize, the player has an opportunity to win Game 2 as well. If the number contained in the wager receipt for Field B matches the generated number for Field B at step 550, the player wins a cash prize equal to fifty dollars ($50) for every one dollar ($1) wagered at step 570, just as described in Game 2 above. If the generated winning number for Field B does not match the number on the wager receipt, the player loses the game along with his or her wager for Game 2 and the game ends at step 565.

If, however, the four (4) generated winning numbers for Field C match all four (4) of the numbers on the wager receipt for Field C, the player then compares the generated winning number for Field A with the number on the wager receipt for Field A at step 530. If the generated winning number for Field A matches the number for Field A on the wager receipt, the player then compares the generated winning number for Field B with the number on the wager receipt for Field B at step 535. If the generated winning number for Field B matches the number on the wager receipt for Field B, the player wins the game and a cash prize equal to a jackpot equal to a predetermined amount set by the state lottery commission at step 570.

If the generated winning number for Field A matches the number for Field A on the wager receipt, but the generated winning number for Field B does not match the number for Field B on the wager receipt, the player wins a secondary cash prize to be determined by the state's lottery commission at step 575. If the generated winning number for Field B matches the number for Field B on the wager receipt, but the generated winning number for Field A does not match the number for Field A on the wager receipt, the player wins a secondary cash prize to be determined by the state's lottery commission at step 575.

If the generated winning number for Field A does not match the number for Field A on the wager receipt and the generated winning number for Field B does not match the number for Field B on the wager receipt, the player loses the game and his or her wager and the game ends at step 580.

The examples of wager and cash prize amounts described above have been employed merely to illustrate an embodiment of the present invention. It is to be understood that Game 1, Game 2, and Game 3 may be played with any cash denominations for wagers and cash prizes for jackpots and secondary cash payouts, as determined by the entity controlling the operation of the game.

As stated previously, one particular game of the three, any combination of two of the three games (Games 1 and 2, Games 1 and 3, or Games 2 and 3), or all of the games may be played according to the desires of the player. It is also to be understood that the numbers available for selection in Field A 12 (ten), Field B 14 (ten), and Field C 16 (thirty) have been presented in this manner to aid in fully describing an embodiment of the present invention. Any combination of numbers may be used in each of the different fields as determined by the entity conducting the game. Also, any amount of wager and cash prizes may be used as determined by the entity conducting the game. The amounts for wagers and cash prizes used above are merely illustrative to aid in describing an embodiment of the present invention.

The present invention has been particularly shown and described with reference to the foregoing embodiment, which is merely illustrative of the best modes presently known for carrying out the invention. It should be understood by those skilled in the art that various alternatives to the embodiment of the invention described herein may be employed in practicing the invention without departing from the spirit and scope of the invention as defined in the following claims. It is intended that the following claims define the scope of the invention and that the method within the scope of these claims and their equivalents by covered thereby. This description of the invention should be understood to include all novel and non-obvious combination of elements described herein, and claims may be presented in this or a later application to any novel non-obvious combination of these elements. Moreover, the foregoing embodiment is illustrative, and no single feature or element is essential to all possible combinations that may be claimed in this or a later application.

What is claimed is:

1. A method for simultaneously conducting multiple lottery style games of chance allowing for multiple wagers and multiple payouts, comprising the steps of:

selecting only one number from a first group of numbers for entry into a Game 1;

selecting only one number from the first group of numbers and only one number from a second group of numbers for entry into a Game 2;

selecting only one number from the first group of numbers, only one number from the second group of numbers, and multiple numbers from a third group of numbers for entry into a Game 3;

conducting a single drawing of winning numbers for Game 1, Game 2, and Game 3;

randomly generating only one winning number from the first group of numbers;

randomly generating only one winning numbers from the second group of numbers;

randomly generating multiple winning numbers from the third group of numbers; and awarding a first prize in Game 1 if the selected number from the first group of numbers matches the randomly generated winning number from the first group of numbers;

awarding a second prize in Game 2 if the selected number from the first group of numbers matches the randomly generated winning number from the first group of numbers and the selected number from the second group of numbers matches the randomly generated winning number from the second group of numbers; and awarding a third prize in Game 3 if the selected number from the first group of numbers matches the randomly generated winning number from the first group of numbers, the selected number from the second group of numbers matches the randomly generated winning number from the second group of numbers and the selected multiple numbers from the third group of numbers matches the multiple randomly generated winning numbers from the third group of numbers.

2. The method as recited in claim 1, wherein the first group of numbers comprises the numbers zero through nine.

3. The method as recited in claim 1, wherein the second group of numbers comprises the numbers zero through nine.

4. The method as recited in claim 1, wherein the third group of numbers comprises the numbers one through thirty.

5. The method as recited in claim 1, wherein the multiple numbers selected from the third group is four.

6. The method as recited in claim 1, wherein the player selects the number from the first group by requesting that the number be randomly generated.

7. The method as recited in claim 1, wherein the player selects the number from the second group by requesting that the number be randomly generated.

8. The method as recited in claim 1, wherein the player selects multiple numbers from the third group by requesting that the multiple numbers be randomly generated.

9. The method as recited in claim 1, wherein the prizes are cash prizes.

10. The method as recited in claim 9, further including the step of determining the amount of the cash prize based on the amount of the wager placed by the player.

11. The method as recited in claim 1, further comprising the step of awarding a fourth prize based on participation in Game 3 if the selected number from the first group of numbers matches the randomly generated winning number form the first group of numbers or the selected number from the second group of numbers matches the randomly generated winning number from the second group of numbers and the selected multiple numbers from the third group of numbers matches the multiple randomly generated winning numbers from the third groups of numbers.

12. The method as recited in claim 1, further comprising the step of awarding a fifth prize based on participation in Games 1, 2, and 3 if the selected number from the first group of numbers matches the randomly generated winning number form the first group of numbers or the selected number from the second group of numbers matches the randomly generated winning number from the second group of numbers or the selected multiple numbers from the third group of numbers matches the multiple randomly generated winning numbers from the third group of numbers.

13. A method for simultaneously conducting multiple lottery style games of chance allowing for multiple wagers and multiple payouts comprising the steps of:

selecting only one number from a first group of numbers for entry into a Game 1;

selecting only one number from the first group of numbers and only one number from a second group of numbers for entry into a Game 2;

selecting only one number from the first group of numbers, only one number from the second group of numbers, and multiple numbers from a third group of numbers for entry into a Game 3;

conducting a single drawing of winning numbers for Game 1, Game 2, and Game 3;

randomly generating only one winning number from the first group of numbers;

randomly generating only one winning number from the second group of numbers;

randomly generating multiple winning numbers from the third group of numbers;

comparing the selected number from the first group of numbers with the randomly generated winning number from the first group of numbers in Game 1;

comparing the selected number from the first group of numbers with the randomly generated winning number from the first group of numbers and comparing the selected number from the second group of numbers with the randomly generated winning number from the second group of numbers in Game 2;

comparing the selected number from the first group of numbers with the randomly generated winning number from the first group of numbers, comparing the selected number from the second group of numbers with the randomly generated winning number from the second group of numbers, and comparing the selected multiple numbers from the third group of numbers with the randomly generated numbers from the third group of numbers in Game 3;

awarding a first prize in Game 1 if the selected number from the first group of numbers matches the randomly generated winning number from the first group of numbers;

awarding a second prize in Game 2 if the selected number from the first group of numbers matches the randomly generated winning number from the first group of numbers and the selected number from the second group of numbers matches the randomly generated winning number from the second group of numbers; and awarding a third prize in Game 3 if the selected number from the first group of numbers matches the randomly generated winning numbers from the first group of numbers, the selected number from the second group of numbers matches the randomly generated winning number from the second group of numbers, and the selected multiple numbers from the third group of numbers matches the multiple randomly generated winning numbers from the third group of numbers.

14. The method as recited in claim 13, wherein the first group of numbers comprises the numbers zero through nine.

15. The method as recited in claim 13, wherein the second group of numbers comprises the numbers zero through nine.

16. The method as recited in claim 13, wherein the third group of numbers comprises the numbers one through thirty.

17. The method as recited in claim 13, wherein the multiple numbers selected from the third group is four.

18. The method as recited in claim 13, wherein the player selects the number from the first group by requesting that the number be randomly generated.

19. The method as recited in claim 13, wherein the player selects the number from the second group by requesting that the number be randomly generated.

20. The method as recited in claim 13, wherein the player selects multiple numbers from the third group by requesting that the multiple numbers be randomly generated.

* * * * *